US006785112B2

(12) United States Patent
Reischl et al.

(10) Patent No.: US 6,785,112 B2
(45) Date of Patent: Aug. 31, 2004

(54) METHOD AND DEVICE FOR TRIGGERING A FUEL INJECTOR

(75) Inventors: Rolf Reischl, Stuttgart (DE); Andreas Eichendorf, Schorndorf (DE); Ulf Pischke, Stuttgart (DE); Juergen Eckhardt, Markgroeningen (DE); Klaus Mueller, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 155 days.

(21) Appl. No.: 09/979,353

(22) PCT Filed: Sep. 2, 2001

(86) PCT No.: PCT/DE01/00499

§ 371 (c)(1),
(2), (4) Date: Aug. 8, 2002

(87) PCT Pub. No.: WO01/71174

PCT Pub. Date: Sep. 27, 2001

(65) Prior Publication Data

US 2003/0010325 A1 Jan. 16, 2003

(30) Foreign Application Priority Data

Mar. 22, 2000 (DE) ..... 100 14 228

(51) Int. Cl.[7] ..... H01H 47/00
(52) U.S. Cl. ..... 361/154; 123/478
(58) Field of Search ..... 361/153, 154, 361/152, 155; 123/478, 490, 472

(56) References Cited

U.S. PATENT DOCUMENTS 4,327,693 A * 5/1982 Busser ..... 123/490
4,479,161 A * 10/1984 Henrich et al. ..... 361/154
4,486,703 A * 12/1984 Henrich ..... 323/222
4,729,056 A * 3/1988 Edwards et al. ..... 361/153
6,031,707 A 2/2000 Meyer

FOREIGN PATENT DOCUMENTS

| | | |
|---|---|---|
| DE | 28 28 678 | 4/1980 |
| DE | 197 46 980 | 4/1999 |
| DE | 198 33 830 | 2/2000 |
| FR | 2 775 825 | 9/1999 |

* cited by examiner

*Primary Examiner*—Gregory J. Toatley, Jr.
*Assistant Examiner*—Boris Benenson
(74) *Attorney, Agent, or Firm*—Kenyon & Kenyon

(57) ABSTRACT

A method and device for triggering a solenoid valve for injecting fuel into an internal combustion engine is described. The triggering phase of the solenoid valve is subdivided into a pull-up phase and a holding phase. During the pull-up phase, a valve needle of the solenoid valve is caused to open by a first current intensity flowing through a magnetic coil of the solenoid valve. During the holding phase, the valve needle is held in the open state by a second, lower current intensity flowing through the magnetic coil. At least once at the beginning of the pull-up phase, a booster phase is activated during which a pulse-shaped booster current from a booster capacitor charged to a high voltage flows through the magnetic coil. During the triggering phase of the solenoid valve, a plurality of booster pulses are activated in succession, whose time position within the triggering phase is freely selectable.

9 Claims, 2 Drawing Sheets

METHOD AND DEVICE FOR TRIGGERING A FUEL INJECTOR

FIELD OF INVENTION

The present invention relates to a method and a device for triggering a solenoid valve, particularly for injecting fuel into an internal combustion engine.

BACKGROUND INFORMATION

German Patent Application Ser. No. 197 46 980 describes a method and a device for triggering a solenoid valve in which the triggering phase of the solenoid valve is subdivided into a pull-up phase and a holding phase. During the pull-up phase, a valve needle of the solenoid valve is caused to open by a first current intensity flowing through a magnetic coil of the solenoid valve. During the holding phase, the valve needle is held in the open state by a second, lower current intensity flowing through the magnetic coil. At least once at the beginning of the pull-up phase, a booster phase is activated during which a pulse-shaped booster current from a booster capacitor charted to a high voltage or from another current source flows through the magnetic coil.

FIGS. 1 and 2 show, in the form of signal diagrams, the characteristic of the voltage and of the current at and through, respectively, a magnetic coil of an injector during a triggering phase composed of a pull-up phase $T_A$ and a holding phase $T_H$, and specifically, FIG. 1 for the case when the supply battery has a normal voltage level, e.g. $U_{BATT}$=14 V, and FIG. 2 for the case when the supply battery has too low a voltage level of less than, for example, 14 V.

As shown in FIG. 1, after the initial current maximum $I_{BOOST}$, caused by a first booster phase $B_1$ with great booster voltage $U_{BOOST}$, the current reaches a pull-up current level $I_A$ by which the valve needle of the solenoid valve is able to pull up. It is clear that booster voltage $U_{BOOST}$, which is impressed on the solenoid valve during booster phase $B_1$, is much greater than battery voltage $U_{BATT}$. During pull-up phase $T_A$, pull-up current level $I_A$ is regulated by repeatedly impressing battery voltage $U_{BATT}$ on the magnetic coil. Pull-up phase $T_A$ is followed initially by a brief free-running phase or a rapid extinction, during which the current through the magnetic coil of the injector decreases very rapidly and a holding-current level $I_H$ is reached which, during holding phase $T_H$, is regulated to a setpoint level by repeated pulse-shaped impressing of battery voltage $U_{BATT}$. At the end, following holding phase $T_H$, there is again a free-running phase or rapid extinction, at whose end the current through the magnetic coil is completely decayed.

FIG. 2 shows the case when the valve needle is unable to pull up during pull-up phase $T_A$ because of too low a battery voltage $U_{BATT2}$ (FIG. 2)<$U_{BATT}$ (FIG. 1). Thus, particularly at low battery voltage accompanied by a given ohmic resistance in the circuit, sufficient pull-up current for the solenoid injection valve cannot be built up, that is to say, ($I<I_A$). FIG. 2 shows that current I through the magnetic coil falls off very rapidly and the regulating range of the pull-up current is not reached, and therefore reliable opening of the solenoid valve may no longer be ensured.

In order to achieve good dynamic response of the valve, the level of the current through the injector should remain at a high level as much as possible during the entire opening movement of the valve needle in pull-up phase $T_A$. Because of the high withdrawal of energy from the internal booster capacitor, a theoretically conceivable, long booster phase producing this high current level over the entire pull-up phase may not be sensible. In realistic applications, the booster phase may be used to achieve a high current level as quickly as possible, a large portion of the booster energy being converted into eddy currents at the beginning of pull-up phase $T_A$. Even before the valve needle is completely open, under certain operating conditions, booster phase $B_1$ is broken off, the valve current is driven from the battery, and decreases. Thus, during the actual flight phase, which is the phase during which the valve needle moves, the magnetic force has already fallen again from its maximum value resulting in a poor dynamic response of the solenoid valve.

SUMMARY OF THE INVENTION

In view of the disadvantages of conventional methods described above, an object of the present invention is to utilize the booster energy economically and, in addition, to improve the switch-on performance of the valve, despite given a small battery voltage.

According to one aspect of the present invention, this object may be achieved by activating a plurality of booster pulses in succession during the triggering phase of the solenoid valve. In principle, their time position within the triggering phase may be freely selectable.

Thus, in a first exemplary embodiment of the present invention, after the first booster pulse is activated at the beginning of the pull-up phase, a further booster pulse can be activated still prior to or during the flight phase of the valve needle.

According to a second exemplary embodiment, after the first booster pulse is activated at the beginning of the pull-up phase, a further booster pulse can be activated at the end or immediately after the flight phase of the valve needle.

Finally, according to a third exemplary embodiment, a further booster pulse or a plurality of further booster pulses can be activated during the holding phase of the solenoid valve, if the voltage of the supply battery lies below a specific threshold voltage during this holding phase.

The exemplary embodiments of the present invention described above can also be combined with one another.

The energy or the maximum current of the individual booster pulses can be reduced by the repeated boosting compared to one long single boosting with a very high current intensity. A reduced peak current intensity may result in a lower load of the bonding pads for integrated circuits, of hybrid assemblies, and a smaller storage capacitance of the booster capacitor.

By suitable selection of the moments for the second and possibly third booster pulse, the buildup of the magnetic force can be freely varied timewise. This leads to a decrease in the eddy-current formation, and booster energy can be supplied depending on the need of the solenoid valve as a function of time. In this manner, the pull-up movement of the valve needle away from the lower limit-stop point can be supported, the needle flight can be accelerated, and stop bounces at the upper limit stop of the valve needle can be suppressed.

Furthermore, given too low a battery voltage which may not be enough to drive a sufficiently high current through the high-pressure injector, the current level can nevertheless be raised by the multiple boosting, and thus reliable operation of the high-pressure solenoid injection valve can be ensured.

BRIEF DESCRIPTION OF THE DRAWINGS

In the following, exemplary embodiments of the present invention are explained in greater detail with reference to the Drawings.

DETAILED DESCRIPTION

Figure 3A:
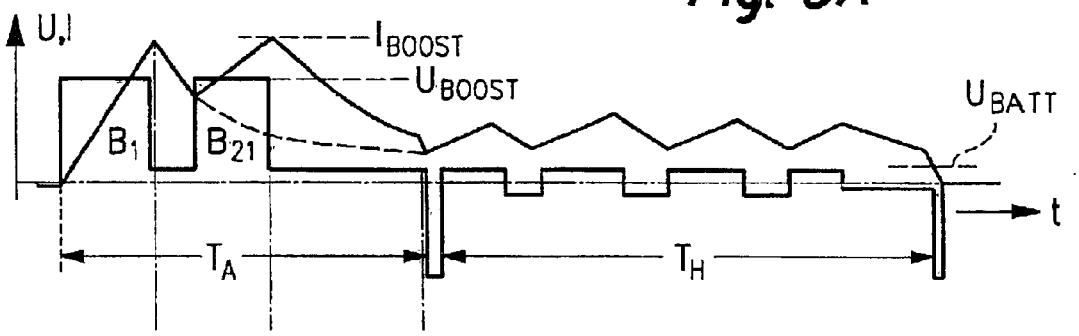
FIG. 3A shows graphically, in the form of a signal-time diagram, the current characteristic through a magnetic coil according to a first exemplary embodiment of the method of the present invention with double boosting.
Figure 3B:
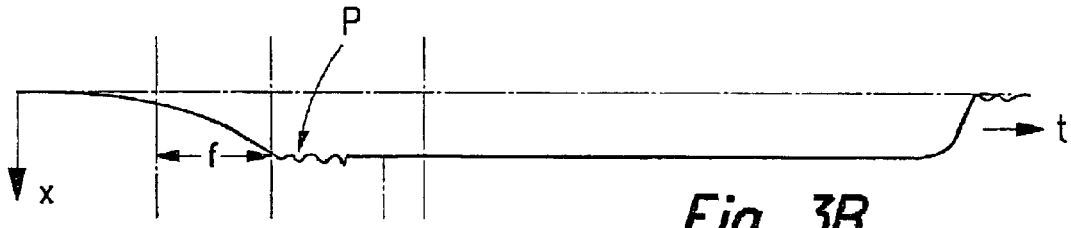
FIG. 3B shows graphically the excursion of a valve needle during the triggering phase of a high-pressure solenoid injection valve.

The graphic representation in FIG. 3*a* shows a first exemplary embodiment of the method according to the present invention in which, given a relatively low battery voltage $U_{BATT}$, a double boosting takes place. That is to say, after first booster pulse $B_1$ is activated at the beginning of pull-up phase $T_A$, a further booster pulse $B_{21}$ is activated which, as a comparison with FIG. 3B showing excursion X of the valve needle makes clear, takes place during flight phase f of the valve needle. The drop in current through the magnetic coil, indicated by a dotted line in FIG. 3A, can thereby avoided, so that the regulating range of the pull-up current can be reached in spite of low battery voltage $U_{BATT}$, and reliable opening of the valve may be ensured. Thus, despite given low battery voltage $U_{BATT}$, the current level can be held up during pull-up phase $T_A$ by the double boosting, and the valve may thereby be reliably opened.

Figure 3C:
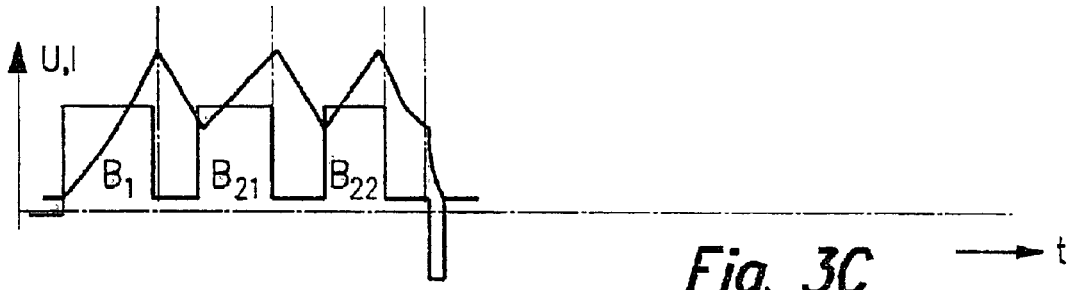
FIG. 3C shows graphically the current and voltage characteristic over time of a second exemplary embodiment of the present invention with triple boosting.

FIG. 3C shows a second exemplary embodiment of the triggering method according to the present invention, in which immediately after the flight phase, after second booster pulse $B_{21}$, a third booster pulse $B_{22}$ is activated which suppresses bounce p of the valve needle at the upper limit stop.

According to a further exemplary embodiment, a further booster pulse or a plurality of further booster pulses can be activated during holding phase $T_H$, in the event holding current $I_H$ can no longer be procured from the battery because of a high ohmic resistance in the circuit.

The triggering method shown in the Figures may be carried out by a device for triggering a solenoid valve for injecting fuel into an internal combustion engine, which subdivides the triggering phase of the solenoid valve into a pull-up phase and a holding phase. During the pull-up phase, a valve needle of the solenoid valve is caused to open by a first current intensity flowing through a magnetic coil of the solenoid valve. During the holding phase, the valve needle is held in the open state by a second, lower current intensity flowing through the magnetic coil. A booster phase is activated at least once at the beginning of the pull-up phase and, in so doing, allows a pulse-shaped booster current from a booster capacitor charged to a high voltage or from another current source to flow through the magnetic coil, the device having means for activating a plurality of booster pulses at selectable moments within the triggering phase of the solenoid valve.

These activation means can be connected to measuring means for measuring at least one of the pull-up current intensity $I_A$, holding current intensity $I_H$, battery voltage $U_{BATT}$ of the supply battery, booster voltage $U_{BOOST}$ and booster current intensity $I_{BOOST}$.

Therefore, in addition to safeguarding the operation of a high-pressure injector at low battery voltage by activating a plurality of booster pulses and thereby raising the current level, thus ensuring that the high-pressure injector can be reliably opened or held open, the method of the present invention permits an economical and variable utilization of the booster energy, in that the eddy-current formation may be reduced by the multiple boosting, and booster energy can be made available depending on the need as a function of time. In this manner, the pull-up movement of the valve needle away from its lower limit-stop point can be supported, the needle flight can be accelerated, and stop bounces at the upper limit stop of the valve needle can be suppressed.

Figure 1:
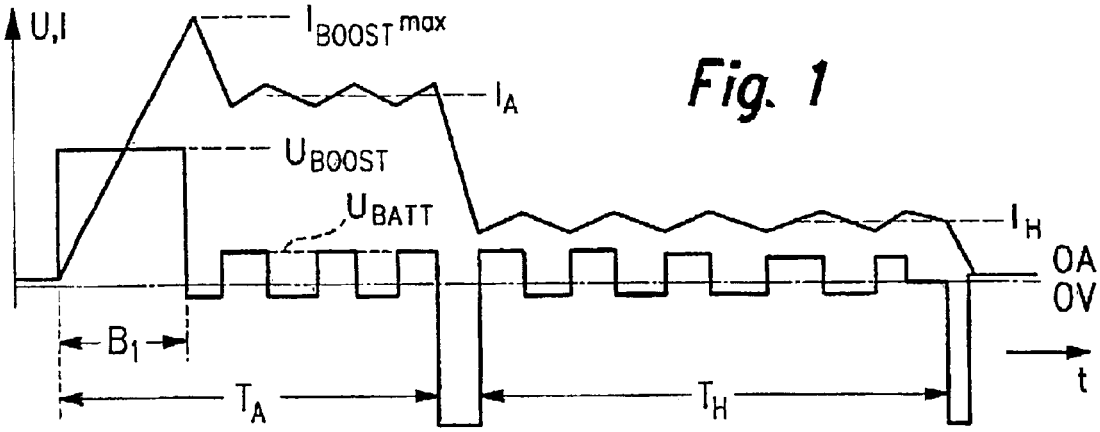
FIG. 1 shows graphically, in the form of a signal-time diagram, the customary characteristic of the current and the voltage, through and at, respectively, a magnetic coil of an injector in the case of single boosting.
Figure 2:
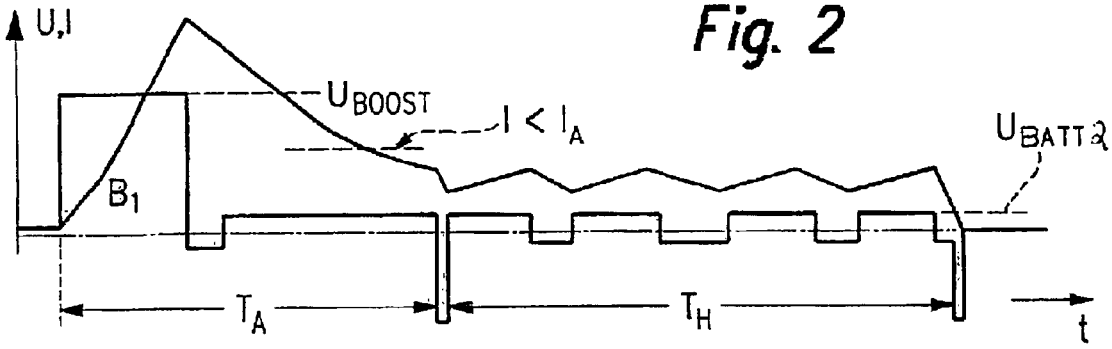
FIG. 2 shows graphically the case when, working with the conventional method having single boosting, the battery voltage becomes too small.

The energy or the maximum current of the single booster pulse can be reduced by the repeated boosting, as a comparison of FIGS. 1 and 2 illustrating the conventional single boosting shows. In this manner, the peak load of the bonding pads for the integrated circuits and of the hybrid assemblies, and the storage capacitance of the booster capacitor can be reduced.

What is claimed is:

1. A method for triggering a solenoid valve, the solenoid valve including a valve needle and a magnetic coil, the method comprising:

activating a triggering phase, the triggering phase including a pull-up phase and a holding phase, the pull-up phase including applying to the magnetic coil a current at a first intensity so that the valve needle is caused move to an open state, the holding phase including applying to the magnetic coil a current at a second intensity so that the valve needle is held in the open state, the second intensity being less than the first intensity;

activating a booster phase during the triggering phase, the booster phase including applying to the magnetic coil a plurality of pulses in succession at selectable times.

2. The method according to claim 1, wherein when the valve needle is the open state, fuel is injected into an internal combustion engine.

3. The method according to claim 1, further comprising:

generating the booster pulses using a booster capacitor charged to a high voltage.

4. The method according to claim 2, wherein a first booster pulse of the plurality of booster pulses is activated at a beginning of the pull-up phase, and wherein at least one further booster pulse of the plurality of booster pulses is activated after first booster pulse.

5. The method according to claim 4, where the at least one further booster pulse is activated at least one of before, during and after a flight phase of the valve.

6. The method according to claim 1, further comprising:

applying at least one further booster pulse during the holding phase if a voltage supplied by a battery is less than a preselected threshold value.

7. A device for triggering a solenoid valve, the solenoid valve including a valve needle and a magnetic coil, the device comprising:

a first arrangement configured to activate a triggering phase, the triggering phase including a pull-up phase and a holding phase, the pull-up phase including an application to the magnetic coil of a current at a first intensity so that the valve needle of the solenoid valve is caused to open, the holding phase including an application to the magnetic coil of a current at a second intensity so that the valve needle is held open; and a second arrangement coupled to the first arrangement and configured to apply to the magnetic coil a plurality of booster pulses at selectable times during the triggering phase.

8. The device according to claim 7, further comprising:

a third arrangement coupled to the second arrangement, the third arrangement configured to measure a pull-up current intensity, a holding current intensity, a battery voltage of a supply battery, a booster voltage, and a booster current intensity.

9. A method for triggering a high-pressure solenoid injection valve for directly injecting gasoline into a combustion engine, the solenoid injection valve including a valve needle and a magnetic coil, the method comprising:

activating a triggering phase, the triggering phase including a pull-up phase and a holding phase, the pull-up phase including applying to the magnetic coil a current at a first intensity so that the valve needle is caused move to an open state, the holding phase including applying to the magnetic coil a current at a second intensity so that the valve needle is held in the open state, the second intensity being less than the first intensity; and activating a booster phase during the triggering phase, the booster phase including applying a plurality of pulses in succession to the magnetic coil at selectable times.

* * * * *